US012497956B2

(12) United States Patent
Morreale

(10) Patent No.: US 12,497,956 B2
(45) Date of Patent: Dec. 16, 2025

(54) PUMP POWER END FRAME

(71) Applicant: A&W Energy, LLC, Fort Worth, TX (US)

(72) Inventor: John D. Morreale, Houston, TX (US)

(73) Assignee: A&W Energy, LLC, Fort Worth, TX (US)

( * ) Notice: Subject to any disclaimer, the term of this patent is extended or adjusted under 35 U.S.C. 154(b) by 0 days.

(21) Appl. No.: 18/419,937

(22) Filed: Jan. 23, 2024

(65) Prior Publication Data

US 2024/0271614 A1 Aug. 15, 2024

Related U.S. Application Data

(60) Provisional application No. 63/440,810, filed on Jan. 24, 2023.

(51) Int. Cl.

| | |
|---|---|
| ***F04B 19/22*** | (2006.01) |
| *E21B 43/26* | (2006.01) |
| *F04B 9/02* | (2006.01) |
| *F04B 15/02* | (2006.01) |

(52) U.S. Cl.

CPC ..... *F04B 19/22* (2013.01); *E21B 43/2607* (2020.05); *F04B 9/02* (2013.01); *F04B 15/02* (2013.01)

(58) Field of Classification Search

CPC ..... F04B 53/006; F04B 1/141; F04B 53/18; F04B 19/22; F04B 9/02; F04B 15/02; E21B 43/2607

See application file for complete search history.

(56) References Cited

U.S. PATENT DOCUMENTS

| | | | | | |
|---|---|---|---|---|---|
| 1,284,964 | A * | 11/1918 | Anderson | F25B 31/002 | 62/468 |
| 3,905,633 | A * | 9/1975 | Larson | B66C 1/66 | 248/499 |
| 5,651,291 | A * | 7/1997 | Lyndhurst | B21J 5/02 | 74/606 R |
| 2009/0283525 | A1* | 11/2009 | Martinez | F01M 11/0408 | 220/235 |
| 2021/0087943 | A1* | 3/2021 | Cui | F04B 1/0439 | |
| 2022/0106951 | A1* | 4/2022 | Foster | F04B 1/0476 | |
| 2024/0175435 | A1* | 5/2024 | Yao | F04B 53/16 | |

FOREIGN PATENT DOCUMENTS

CN 208486927 U * 2/2019

* cited by examiner

*Primary Examiner* — Thomas Fink
(74) *Attorney, Agent, or Firm* — Harper & Bates LLP; Shannon W. Bates

(57) ABSTRACT

A pump power end frame with a fatigue-resistant crankshaft housing machined from a one-piece forging may include machined features and bolted-on accessories. The crankshaft housing and the accessories have no welds that are subject to cracking in response to cyclic stresses due to operation of the pump.

19 Claims, 8 Drawing Sheets

PUMP POWER END FRAME

CROSS-REFERENCE TO RELATED APPLICATIONS

This application claims the benefit of and priority to U.S. Provisional Patent Application Ser. No. 63/440,810 filed Jan. 24, 2023 and entitled "Pump Power End Frame", which is incorporated herein by reference for all purposes.

TECHNICAL FIELD

The present disclosure relates generally to well service pumps, and more particularly to fatigue resistant power end frames for hydraulic fracturing pumps.

BACKGROUND

Hydraulic fracturing pumps, also referred to as "frac pumps", are commonly used in oilfield operations to supply pressurized fluid downhole. Hydraulic fracturing pumps are typically constructed as multi-cylinder reciprocating pumps with a power end and a fluid end. The power end comprises the driving assembly that operates piston plungers to reciprocate into and out of the cylinders of the fluid end of the pump.

SUMMARY

A pump power end frame provides a fatigue-resistant crankshaft housing machined from a one-piece forging. The crankshaft housing may include machined features and/or bolted-on accessories. The crankshaft housing and the accessories have no welds that are subject to cracking in response to cyclic stresses due to operation of the pump.

The details of one or more implementations of the pump power end frame of the present disclosure are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

A hydraulic fracturing pump may be a multi-cylinder reciprocating pump with a power end and a fluid end. The power end drives piston plungers reciprocating into and out of cylinders in the fluid end. As a result, fluid is drawn into the cylinders of the fluid end through a suction manifold and then discharged under pressure through a discharge outlet of the fluid end.

The power end of a well service pump operates by rotating a crankshaft that drives connecting rods in a reciprocating fashion. Each of the connecting rods is coupled to a crosshead that linearly drives a pony rod. The pony rods are connected to piston plungers that reciprocate into and out of cylinders in the fluid end.

The moving components of the power end are housed within a power end frame. Conventional power end frames are formed by welding together multiple plates and other components in various configurations. Other conventional power end frames may be formed from a one-piece casting or a one-piece casting with additional pieces welded to it.

Due to industry demands, well service pumps are exposed to increasingly more severe operating conditions (pressures, temperatures and flow rates). As such, well service pumps can experience significant cyclic stresses during operation. Over time, these cyclic stresses tend to promote fatigue failure in power end frames since weldments and castings are poorly adapted for fatigue applications. For example, welds can have quality issues that promote cracking, welds can be very difficult to inspect, and it is difficult to perform accurate fatigue analysis on welded structures. Castings are porous and can be brittle, thus increasing the chances of cracking during cyclic loading.

The present disclosure is directed to a power end frame with a crankshaft housing formed of a one-piece forging that is better suited for fatigue applications than conventional power end frames. The power end frame further comprises a crosshead section formed of a traditional welded structure, but held in compression by a plurality of long threaded fasteners, referred to herein as stayrods, such that the crosshead section does not experience the same fatigue issues found in conventional power end frames.

Figure 1:
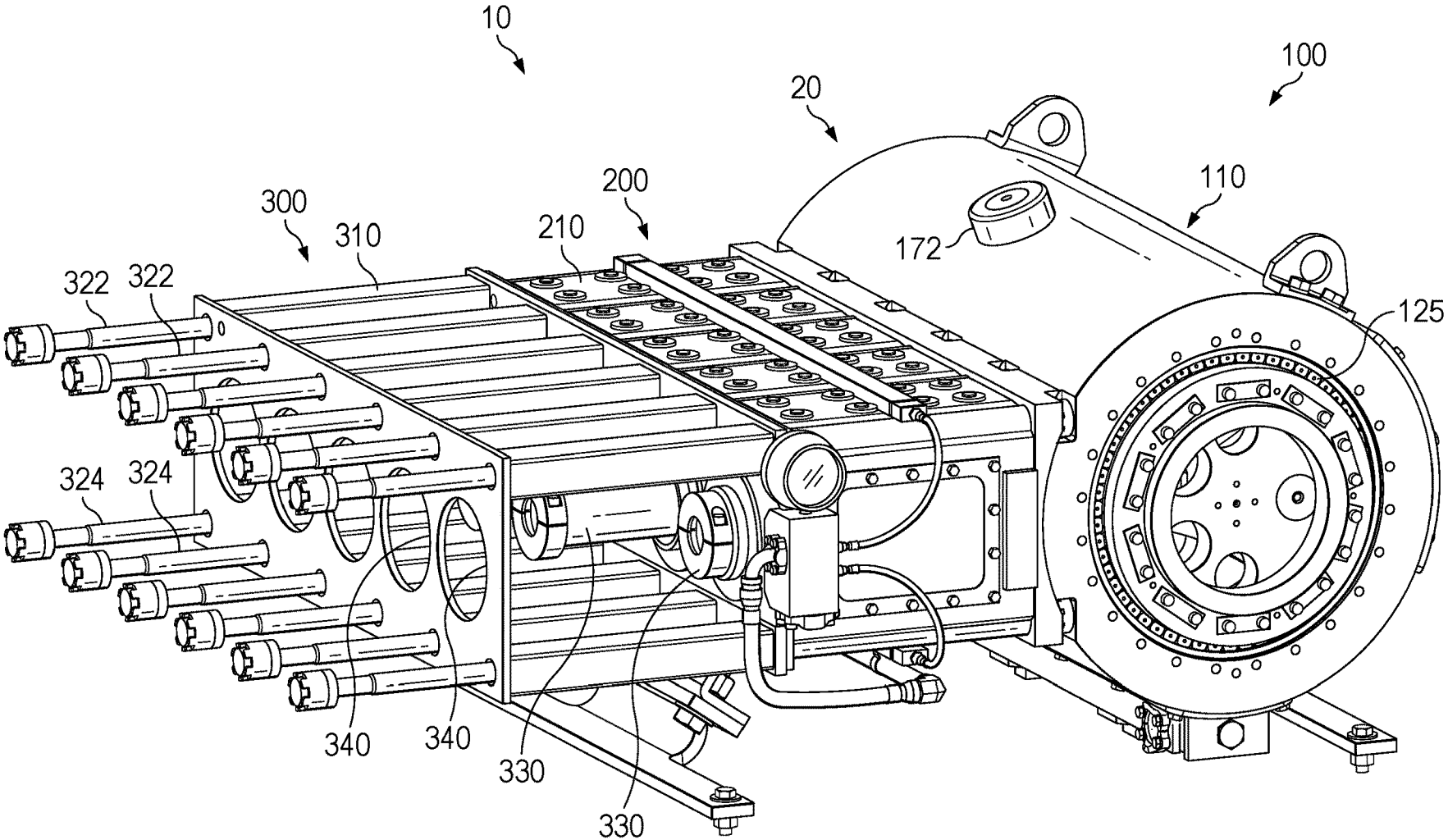
FIG. 1 depicts a side perspective view of a representative power end comprising one implementation of a power end frame according to the present disclosure.
Figure 2:
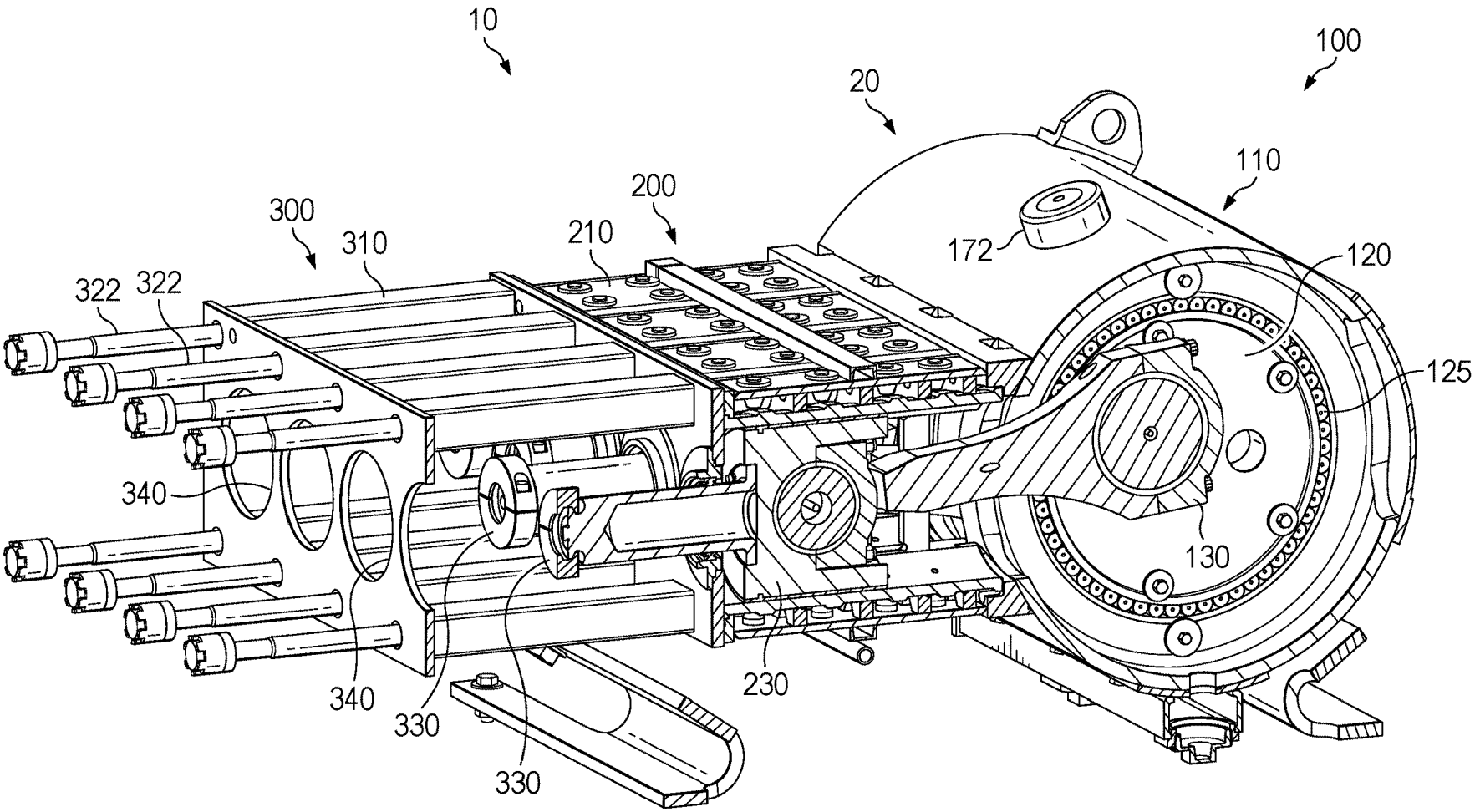
FIG. 2 depicts a side perspective view, partially in cross-section, of the power end shown in FIG. 1.

Referring now to the drawings, where like reference numerals represent like components, FIG. 1 depicts a side perspective view of a representative power end 10 of a five-cylinder hydraulic fracturing pump, also referred to as a quintuplex pump. A three-cylinder hydraulic fracturing pump, also referred to as a triplex pump, is also commonly used in the oilfield. FIG. 2 depicts the same side perspective view of the power end 10 of FIG. 1, but with a portion of the power end 10 shown in cross section.

Power end 10 comprises a crankshaft portion 100, a crosshead portion 200 and a spacer portion 300. A frame 20 of the power end 10 comprises a crankshaft housing 110, a crosshead housing 210 and a spacer housing 310 coupled together by a plurality of upper stayrods 322 and a plurality of lower stayrods 324.

Within the frame 20, a crankshaft 120 is positioned with the crankshaft housing 110 supported by crankshaft bearings 125, and a plurality of connecting rods 130 are coupled to the crankshaft 120 to extend between the crankshaft housing 110 and the crosshead housing 210. A plurality of crossheads 230 each couple to a corresponding one of the plurality of connecting rods 130, and the plurality of crossheads 230 are positioned within the crosshead housing 210. A plurality of pony rods 330 each couple to a corresponding one of the plurality of crossheads 230 to extend between the crosshead housing 210 and the spacer housing 310. The spacer housing 310 further comprises a plurality of openings 340 through which a plurality of fluid end piston plungers (not shown) extend. Each of the fluid end piston plungers couples to a corresponding one of the plurality of pony rods 330.

As previously described, the power end 10 operates by rotating the crankshaft 120 to drive the connecting rods 130 in a reciprocating fashion. Each of the connecting rods 130 is coupled to a corresponding crosshead 230 that linearly drives a pony rod 330. The pony rods 330 are connected to fluid end piston plungers (not shown) that reciprocate through the openings 340 in the spacer housing 310, into and out of cylinders in the fluid end.

Figure 3:
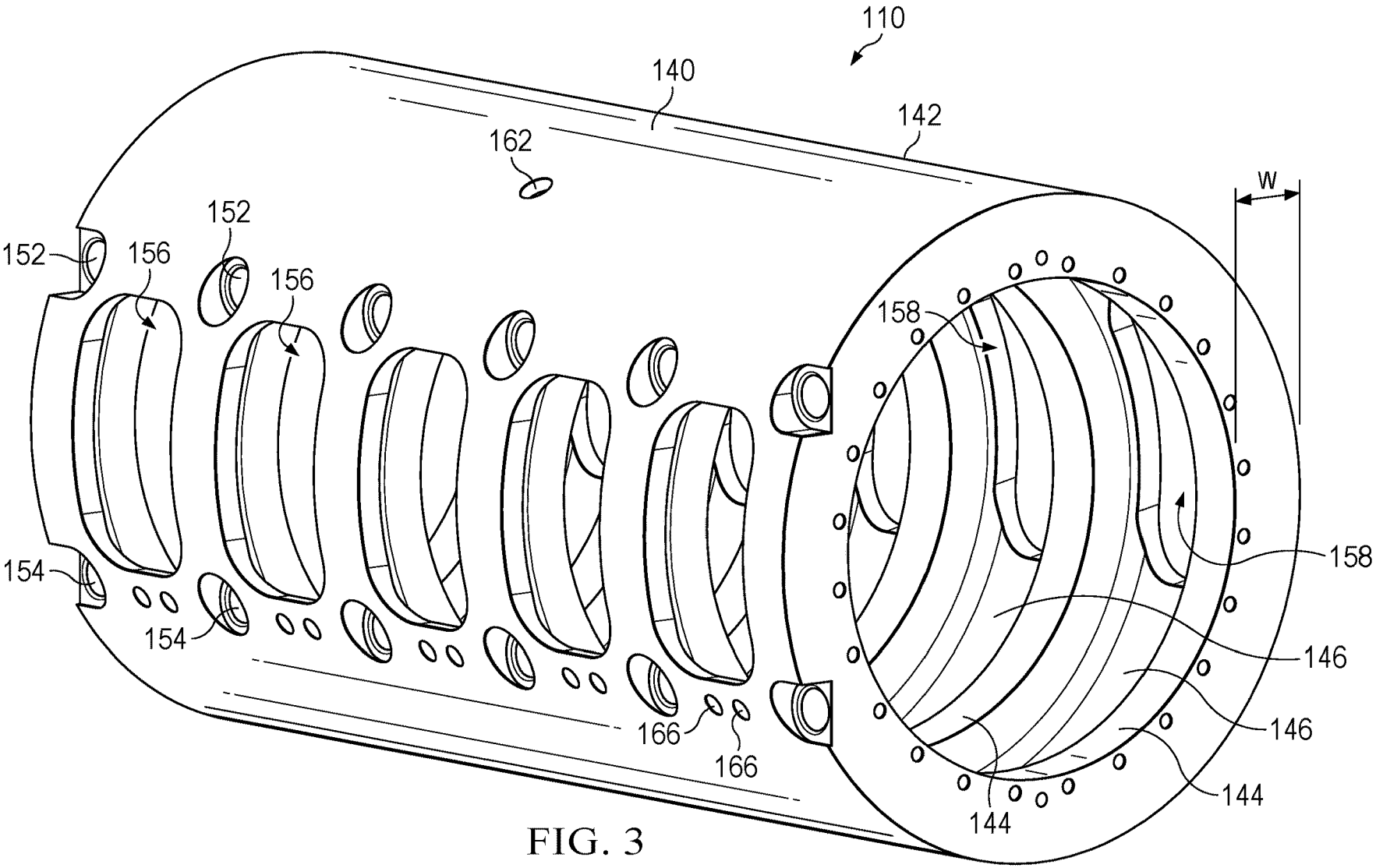
FIG. 3 depicts a front perspective view of a crankshaft housing of the power end frame shown in FIG. 1.
Figure 4:
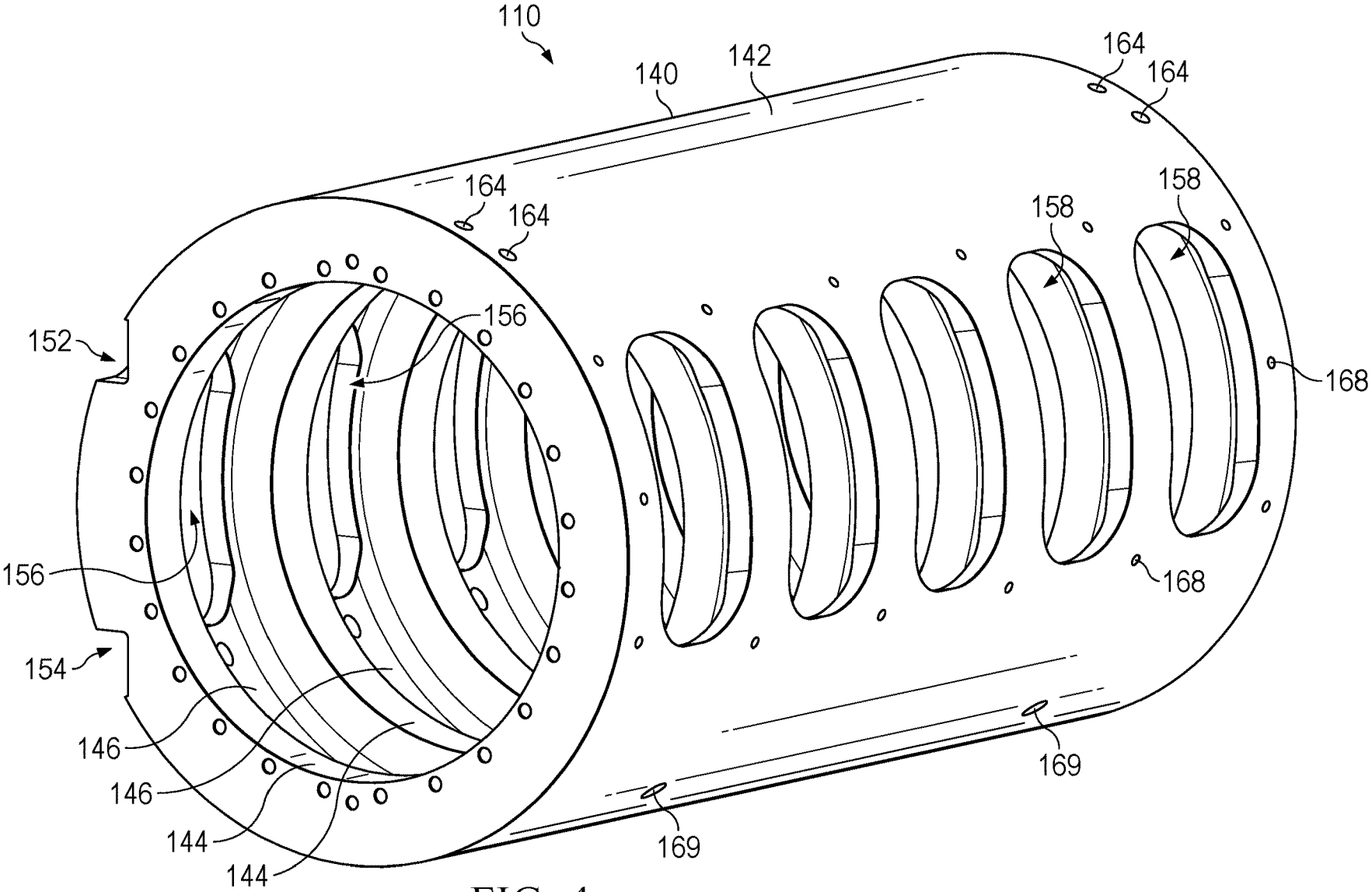
FIG. 4 depicts a back perspective view of the crankshaft housing shown in FIG. 3.

FIG. 3 and FIG. 4 depict a front perspective view and a back perspective view, respectively, of one implementation of a fatigue resistant crankshaft housing 110 according to the present disclosure. The crankshaft housing 110 is machined from a one-piece forging with a substantially cylindrical profile, a substantially round cross section, and no welds that are prone to fatigue failure due to cracking. In one implementation, the crankshaft housing 110 is machined from a one-piece forging of steel to form a crankshaft housing 110 with an outside diameter 142 and a nominal inside diameter 144 that defines a wall thickness W. The crankshaft housing 110 may range from approximately 5 feet to 6 feet long, and the wall thickness W may range from approximately 3 inches to 5 inches. In an implementation, the wall thickness W may be approximately 4-inches. The crankshaft housing 110 may further comprise a plurality of larger bored internal diameter 146 sections alternating with the nominal inside diameter 144 sections. The nominal inside diameter 144 sections may house roller bearings 125 that support the crankshaft 120, while the larger bored internal diameter 146 sections form recesses there between.

The crankshaft housing 110 further comprises simple machined features, such as threaded openings, mounting holes, apertures, and windows, for example, upon which accurate fatigue analysis can be performed. In some implementations, the front side of the crankshaft housing 110 may include machined apertures 156 through which the connecting rods 130 extend. The back side of the crankshaft housing 110 may include corresponding machined windows 158 to provide access to the interior of the crankshaft housing 110 for maintenance, troubleshooting and assembly.

Figure 6:
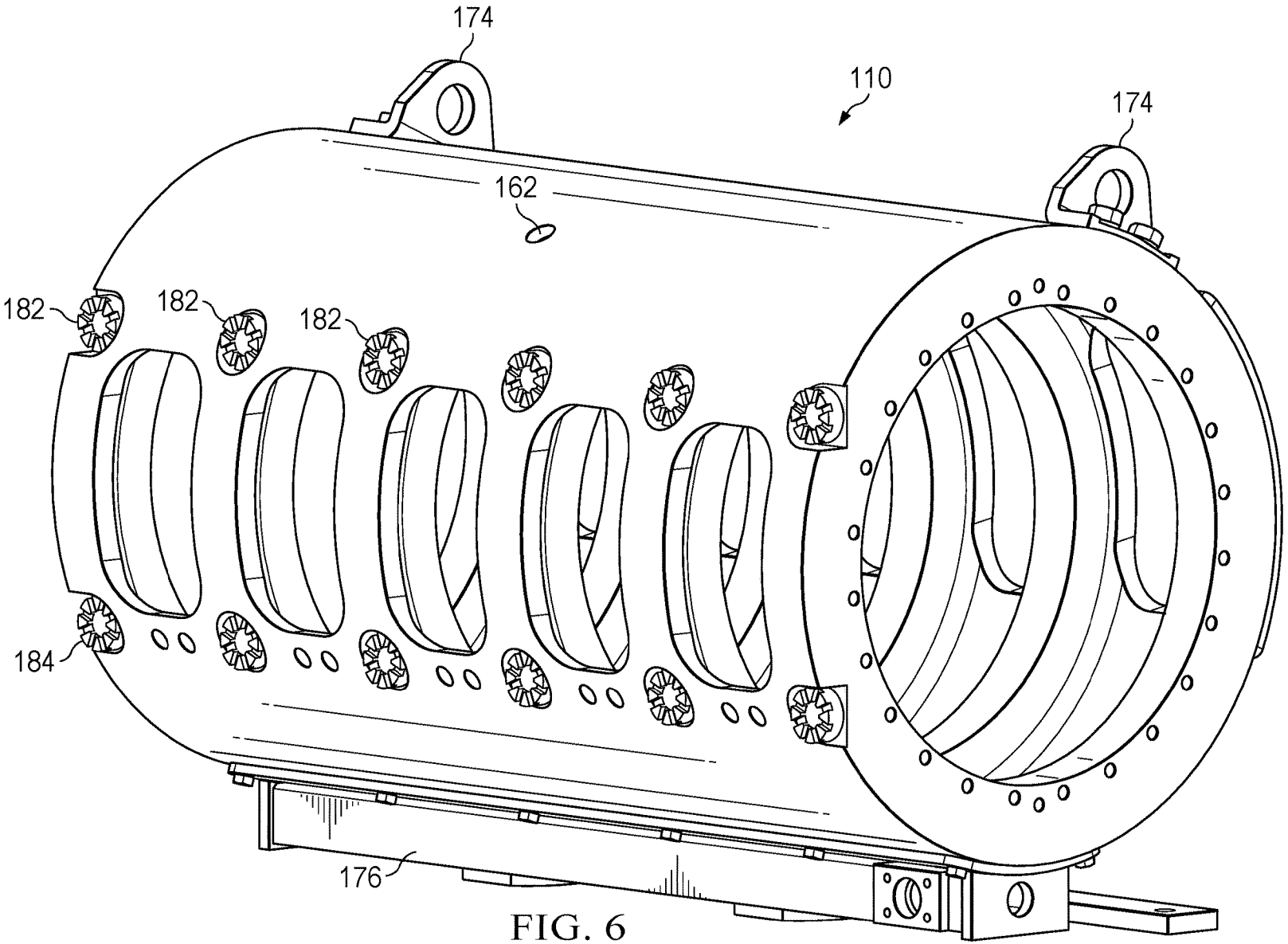
FIG. 6 depicts a front perspective view of the crankshaft housing shown in FIG. 3, and with representative bolt-on accessories coupled thereto.
Figure 7:
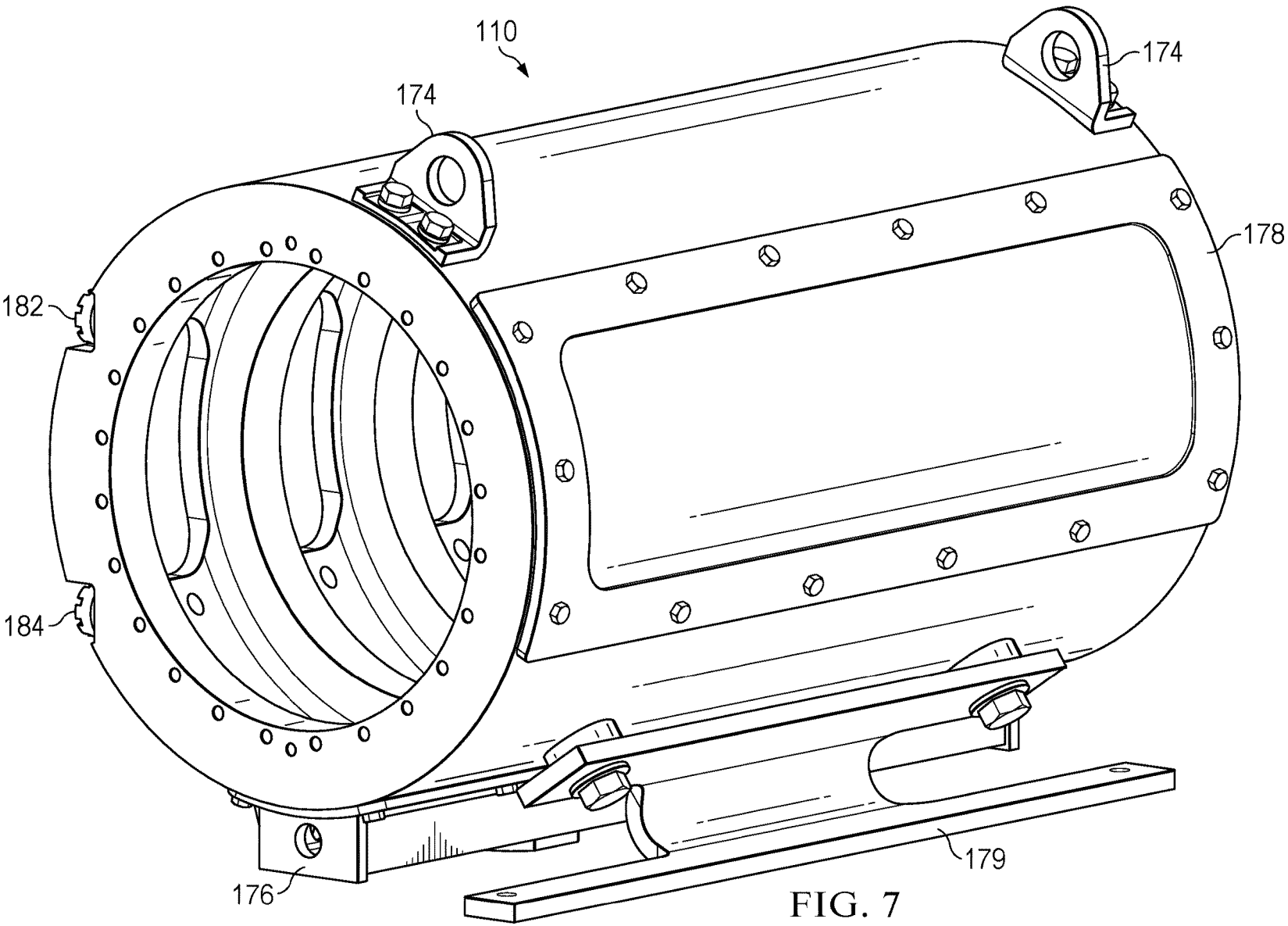
FIG. 7 depicts a back perspective view of the crankshaft housing and bolt-on accessories shown in FIG. 6, including an implementation of a bolt-on mounting leg according to the present disclosure.

Referring again to FIG. 3, the front side of the crankshaft housing 110 may further include a plurality of upper threaded openings 152 and a plurality of lower threaded openings 154 to receive stayrod adapters 182, 184 as further described herein with respect to FIG. 6 and FIG. 7. Likewise, the front side of the crankshaft housing may include one or more mounting holes 162 for bolting on one or more oil breathers 172 (shown in FIG. 1 and FIG. 2) and a plurality of lubricant pass through holes 166 for allowing lubricant to pass between the crosshead housing 210 and the crankshaft housing 110.

Figure 8:
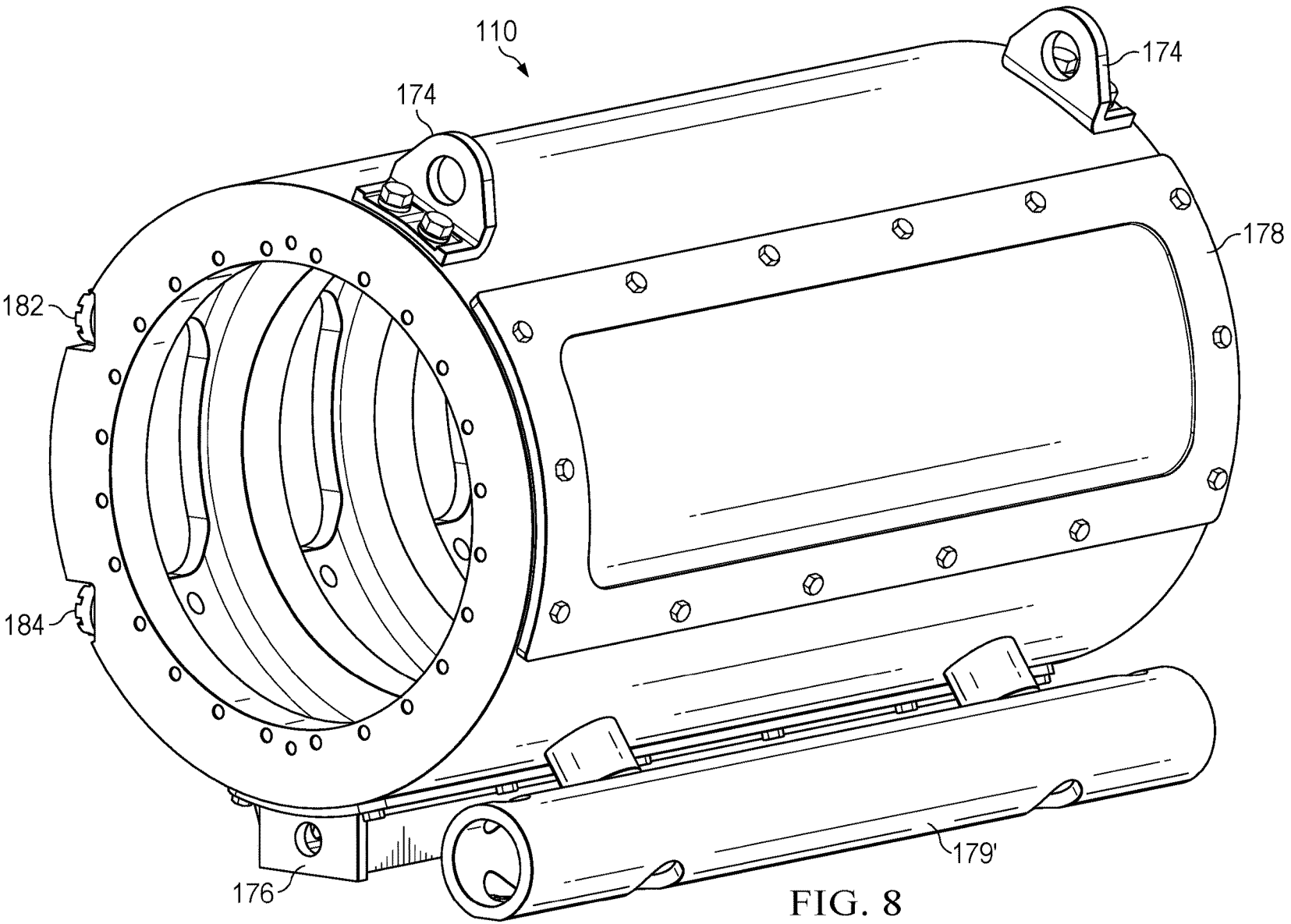
FIG. 8 depicts a back perspective view of the crankshaft housing and bolt-on accessories shown in FIG. 6.

Referring again to FIG. 4, the back side of the crankshaft housing 110 may further include a plurality of mounting holes 164 for coupling lifting eyes 174, a plurality of mounting holes 168 for coupling a curved cover 178, and a plurality of mounting holes 169 for coupling a mounting leg 179 or mounting leg 179', all as further described herein with respect to FIG. 6, FIG. 7 and FIG. 8.

Figure 5:
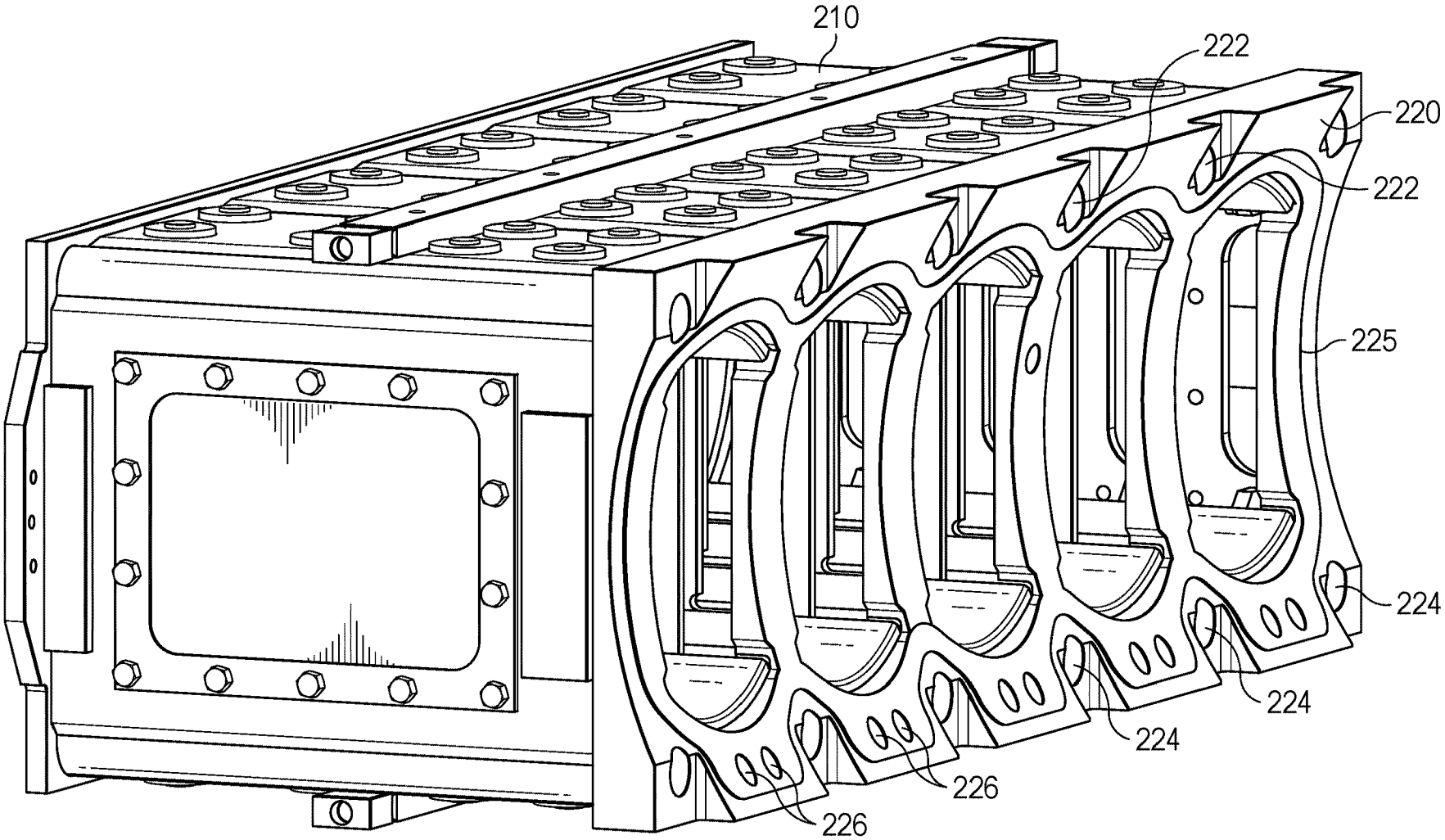
FIG. 5 depicts a back perspective view of a crosshead housing of the power end frame shown in FIG. 1.

FIG. 5 depicts a back perspective view of one implementation of a crosshead housing 210 of the power end frame 20 shown in FIG. 1 and FIG. 2. Given the substantially cylindrical shape of the crankshaft housing 110, the crosshead housing 210 comprises a corresponding curved mating surface 220. In some implementations, a groove is machined into the curved mating surface 220 to receive a sealing mechanism 225, such as a gasket or an o-ring, to provide a seal between the crosshead housing 210 and the crankshaft housing 110.

The crosshead housing 210 further comprises a plurality of lubricant pass through holes 226 corresponding to the lubricant pass through holes 166 on the front of the crankshaft housing 110 to enable passing of lubricant from the crosshead housing 210 to the crankshaft housing 110. The crosshead housing 210 also includes a plurality of upper ports 222 through which the plurality of upper stayrods 322 extend and a plurality of lower ports 224 through which the plurality of lower stayrods 324 extend.

Referring now to FIG. 6, FIG. 7 and FIG. 8, in various implementations, any additional accessories to the crankshaft housing 110 are bolted on rather than being welded on. This approach avoids fatigue failures in these additional accessories due to cracks in weldments used to attach them to the crankshaft housing.

In various implementations, the additional accessories may include upper stayrod adapters 182 with male ends that thread into the upper threaded openings 152 in the crankshaft housing 110, and lower stayrod adapters 184 with male ends that thread into the lower threaded openings 154 in the crankshaft housing 110. The stayrod adapters 182, 184 further include female ends into which the stayrods 322, 324 thread. In conventional power end frames, the stayrods are received directly into threaded openings in the crankshaft housing, or another portion of the power end frame, and such stayrods occasionally break off inside these threaded openings. This stayrod breakage can require major repairs to, or even replacement of, the crankshaft housing or other portions of the power end frame. In contrast, the stayrod adapters 182, 184 of the present disclosure can simply be removed from the crankshaft housing 110 in the event that a stayrod breaks off inside one of these stayrod adapters 182, 184.

As shown in FIG. 6, FIG. 7 and FIG. 8, the additional bolted on accessories may further include a plurality of lift eyes 174 that bolt to the crankshaft housing 110 via mounting holes 164 (shown in FIG. 4), a curved rear cover 178 over the windows 158 that bolts to the crankshaft housing 110 via mounting holes 168 (shown in FIG. 4), an oil sump drain 176 with a curved mounting surface that bolts to the bottom of crankshaft housing 110 via mounting holes, and/or a mounting leg 179, 179' that bolts to the crankshaft housing 110 via mounting holes 169 (shown in FIG. 4).

In some implementations, the curved rear cover 178 is formed of aluminum and a gasket is provided between the cover 178 and the crankshaft housing 110. In some implementations, the mounting leg 179, 179' is formed of a single piece of steel in a substantially or fully rounded shape that acts like a spring to relieve stress on the power end frame 20 during operation. FIG. 7 shows an implementation of the mounting leg 179 formed from a flat piece of steel into a substantially rounded shape to function as a flat style spring. FIG. 8 shows another implementation of the mounting leg 179' formed from a cylindrical piece of steel to provide a fully rounded shape.

Thus, the crankshaft housing 110 is adapted to resist fatigue failure. The crankshaft housing 110 is machined from a one-piece forging, it includes machined features upon which accurate fatigue analysis can be performed, and all additional accessories are bolted to the crankshaft housing 110. As a result, the crankshaft housing 110 itself and the additional accessories have no welds that are subject to cracking in response to cyclic stresses due to operation of the hydraulic fracturing pump.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A pump power end comprising: a crankshaft housing machined from a one-piece forging; a crosshead housing with a first curved mating surface on an exterior wall of the crosshead housing, wherein the first curved mating surface is configured to engage a corresponding second curved exterior mating surface on a wall of the crankshaft housing; and a plurality of stayrods coupling the crosshead housing to the crankshaft housing via the first and second mating surfaces.

2. The pump power end of claim 1:
wherein the crankshaft housing has no welds.

3. The pump power end of claim 1:
wherein the crankshaft housing comprises a substantially ring-shaped cross-section having a wall thickness defined by an outside diameter and a nominal inside diameter.

4. The pump power end of claim 3:
wherein the crankshaft housing further comprises at least one bored section with an internal diameter that is larger than the nominal inside diameter.

5. The pump power end of claim 1:
wherein the crankshaft housing further comprises at least one machined opening through a wall thereof.

6. The pump power end of claim 5:
wherein the at least one machined opening comprises at least one lubricant pass through hole.

7. The pump power end of claim 5:
wherein the at least one machined opening comprises at least one machined aperture through which a connecting rod of the power end extends.

8. The pump power end of claim 5:
wherein the at least one machined opening comprises at least one machined window to provide access to an interior of the crankshaft housing.

9. The pump power end of claim 1, further comprising:
a bolted-on accessory to the crankshaft housing.

10. The pump power end of claim 9:
wherein the bolted-on accessory is a stayrod adapter configured to couple between a machined threaded opening in the crankshaft housing and a threaded stayrod of the plurality of stayrods.

11. The pump power end of claim 9:
wherein the bolted-on accessory is a single-piece mounting leg configured to resist fatigue failures by distributing cyclic stresses.

12. The pump power end of claim 9:
wherein the bolted-on accessory is a curved cover configured to cover a machined window through a wall of the crankshaft housing.

13. The pump power end of claim 9:
wherein the bolted-on accessory is an oil sump drain with a curved mating surface configured to engage the crankshaft housing.

14. The pump power end of claim 9:
wherein the bolted-on accessory is an oil breather.

15. The pump power end of claim 9:
wherein the bolted-on accessory is a lifting eye.

16. The power end of claim 1, further comprising:
a plurality of stayrod adapters, each disposed within a machined threaded opening in the crankshaft housing and configured to receive one of the plurality of stayrods.

17. A well service pump comprising the power end of claim 1.

18. A well service pump comprising the power end of claim 5.

19. A well service pump comprising the power end of claim 9.

* * * * *